US007427733B2

(12) United States Patent
Hares et al.

(10) Patent No.: US 7,427,733 B2
(45) Date of Patent: Sep. 23, 2008

(54) GATED IMAGE INTENSIFIER

(75) Inventors: Jonathan David Hares, Oxfordshire (GB); Paul Michael William French, London (GB)

(73) Assignee: Imperial Innovations Limited, London (GB)

( * ) Notice: Subject to any disclaimer, the term of this patent is extended or adjusted under 35 U.S.C. 154(b) by 142 days.

(21) Appl. No.: 10/577,735

(22) PCT Filed: Sep. 23, 2004

(86) PCT No.: PCT/GB2004/004044

§ 371 (c)(1),
(2), (4) Date: Jun. 8, 2006

(87) PCT Pub. No.: WO2005/055268

PCT Pub. Date: Jun. 16, 2005

(65) Prior Publication Data

US 2007/0092155 A1 Apr. 26, 2007

(30) Foreign Application Priority Data

Nov. 28, 2003 (GB) ..... 0327724.1

(51) Int. Cl.
*H01J 40/14* (2006.01)

(52) U.S. Cl. ..... 250/207; 250/214 VT; 250/214 LA; 250/208.1; 250/483.1; 313/103 R; 313/103 CM; 313/105 CM

(58) Field of Classification Search ..... 250/214 VT, 250/214 LA, 207, 208.1; 600/476, 310; 606/3; 607/88; 313/103 E, 103 CM, 105 R, 105 CM
See application file for complete search history.

(56) References Cited

U.S. PATENT DOCUMENTS

| | | | | |
|---|---|---|---|---|
| 3,885,180 | A | 5/1975 | Carts, Jr. | |
| 4,184,069 | A | 1/1980 | Bosserman | |
| 5,220,164 | A | 6/1993 | Lieber et al. | |
| 5,485,530 | A * | 1/1996 | Lakowicz et al. | 382/191 |
| 5,772,588 | A * | 6/1998 | Miwa et al. | 600/310 |
| 5,919,140 | A | 7/1999 | Perelman et al. | |
| 7,259,362 | B1 * | 8/2007 | Riches et al. | 250/214 VT |

FOREIGN PATENT DOCUMENTS

| | | | |
|---|---|---|---|
| EP | 0 269 356 | A2 | 6/1988 |
| EP | 701185 | A1 * | 3/1996 |
| GB | 2322230 | A * | 8/1998 |
| GB | 2 338 080 | A | 12/1999 |
| GB | 2 349 534 | A | 11/2000 |
| WO | WO 95/14951 | * | 6/1995 |

OTHER PUBLICATIONS

International Search Report of PCT/GB2004/004044, mailed Jun. 28, 2005.
GB Search Report of GB 0327724.1, mailed May 5, 2004.

* cited by examiner

*Primary Examiner*—Stephen Yam
(74) *Attorney, Agent, or Firm*—Nixon & Vanderhye P.C.

(57) ABSTRACT

A gated optical image intensifier 10 is provided with multiple intensifying channels 20, 22, 24, 26 each supplied with radiation via a respective optical channel of an optical splitter. The separate intensifying channels are subject to gating by a sequence of time spaced gating signals generated by an electronic gating signal generator. The multi-channel gated optical image intensifier has particular utility in the field of fluorescence lifetime imaging.

24 Claims, 4 Drawing Sheets

GATED IMAGE INTENSIFIER

This application is the US national phase of international application PCT/GB2004/004044, filed 23 Sep. 2004, which designated the U.S. and claims priority of GB 0327724.1, filed 28 Nov. 2003, the entire contents of each of which are hereby incorporated by reference.

This invention relates to the field of image intensification. More particularly, this invention relates to gated optical image intensification.

Figure 1:
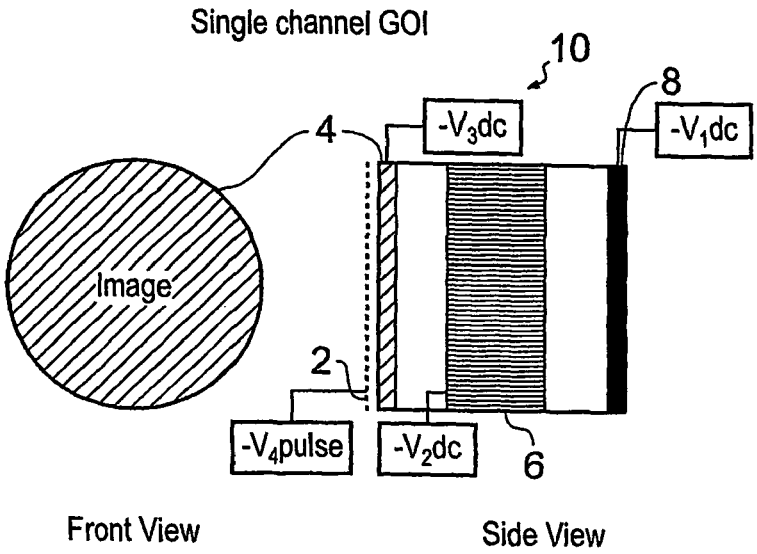

It is known to provide gated optical image intensifiers (GOI), such as those described in British Published Patent Application GB-A-2,183,083. Such devices are capable of taking pictures with high (sub-nanosecond) time resolution. This type of device is based on microchannel plate image intensifier technology, incorporating high speed voltage signals that effectively gate the gain of the image intensifier on very fast time scales. FIG. 1 of the accompanying drawings shows a simple schematic of such a gated image intensifier. A high speed voltage pulse is applied to an electrode mesh 2 in front of a photocathode 4 which induces a pulse on the photocathode 4 by capacitive coupling. When this pulsed voltage is present, the photoelectrons emitted by the photocathode 4 are accelerated toward the microchannel plate 6 and an amplified replica of the incident optical image is observed at the output phosphor screen 8. Typically this output image is recorded on a CCD camera and may be saved as an electronic record on a computer. Thus, by applying a series of short voltage pulses to the mesh 2, it is possible to obtain a series of time-gated images from the image intensifier 10. Because the gating voltage pulse applied to the mesh 2 can be very short, it is possible to gate this image intensifier 10 in less than 100 ps. A slightly different design, in which the gating voltage is applied directly to the photocathode 4, is able to provide gated imaging on timescales as fast as 200 ps. This mode of operation is able to run at repetition rates up to ~1 GHZ, and is described as a high rate imager (HRI).

Figure 2:
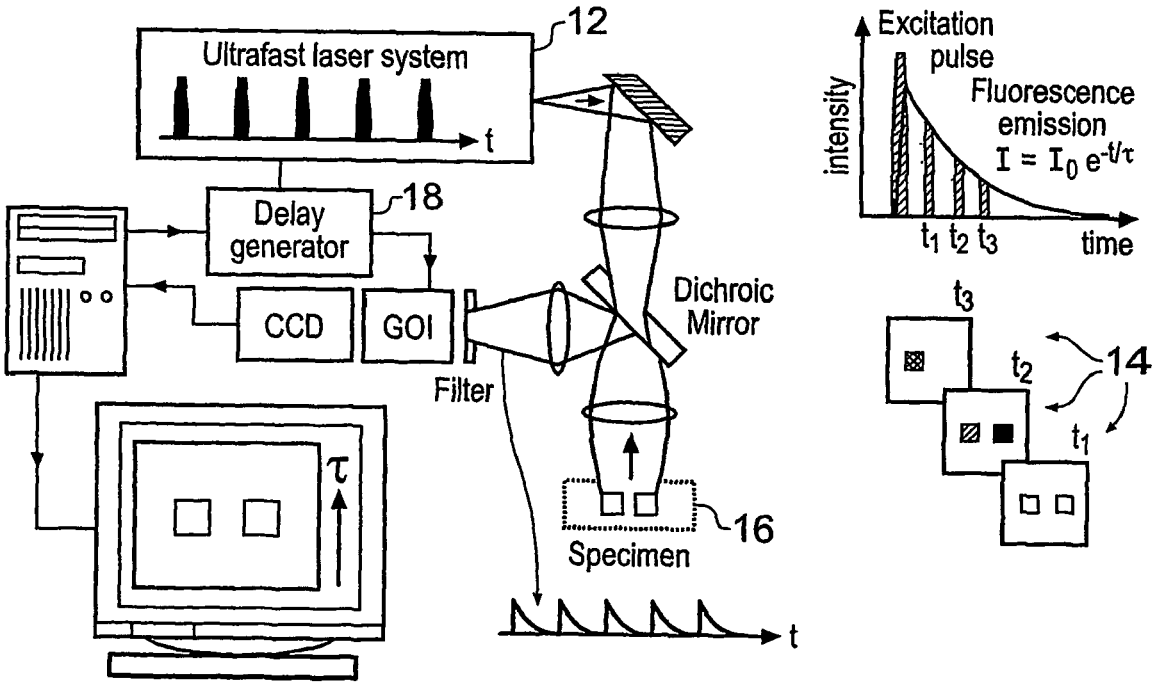

It is known to apply this gated image intensifier technology to fluorescence lifetime imaging (FLIM). Typically this works by repetitively sampling the fluorescence decay of a specimen excited by a periodic laser pulse train 12, as indicated in FIG. 2 of the accompanying drawings. Typically a number of time-gated images 14 are acquired sequentially to sample the array of fluorescence decay profiles emanating from the specimen 16 in order to produce each FLIM lifetime map. This can typically vary between 2 and 20 samples. Unfortunately, being non-optical in nature, the time taken to adjust the delay generator 18 between each time-gated image is of the order 100's ms and this limits the ultimate speed at which time-domain FLIM may be undertaken. Even though this delay switching time can in principal be reduced considerably, it is commonly necessary to integrate for many ms or even seconds over many time-gated acquisitions at each time delay to achieve a useful signal to noise ratio. The total acquisition time is a function of the acquisition time for each delay time, the time taken to adjust the delay and the total number of samples (delays) recorded. Typically, for weak fluorescence signals, such as are often encountered in biological experiments, this can lead to a total acquisition time of many seconds—or even minutes. This limits the scope of fluorescence lifetime imaging of dynamic (e.g. moving or evolving) specimens. Furthermore any movement in the object being imaged is likely to cause errors in the temporal point spread function and thus "single shot" behaviour is highly desirable.

FLIM may also be realised in the frequency domain using a complementary technique that acquires a series of phase-resolved fluorescence images of a specimen excited by a periodically modulated laser beam. The need to repetitively sample the fluorescence signal as a function of phase delay between the excitation and fluorescence signals also results in relatively long data acquisition times that limit the application of this technique to dynamic specimen.

The GOI technology may also be applied to time-resolved imaging, e.g. for imaging through turbid (diffuse) media. For this application there is a requirement to measure the temporal point spread function of a number of signals that have propagated through a scattering medium, such as biological tissue. In particular a GOI or HRI may be employed to simultaneously read-out a number of parallel detection channels that may be fibre-optically coupled to the GOI. Typically, it is desirable to build up a point-spread function of the detected light and the data acquisition time is again limited by the time taken to change the delay of the GOI gate function in order to sample the emerging temporal point spread functions as well as the sequence of integration times at each delay stage.

GOI technology may also be applied to fluorescence correlation spectroscopy (FCS) of multiple beams probing multiple areas of a specimen. In general it may be applied to almost any application involving the characterisation of a periodic optical signal.

The GOI technology may also be applied to high-speed imaging of fast processes. Although it is capable of "freezing" motion on a picosecond timescale, the considerable time (ms to seconds) taken to set each wide-field image acquisition at a different delay, limits the frame-rate to a timescale of seconds unless the system is applied in a periodic sampling mode to analyse a synchronised, repetitive event.

It should be understood that the overall data acquisition time could be reduced if one could simultaneously sample the signal at different delays after excitation or triggering. In the limit, this would mean that a time varying signal, or an array of time-varying signals, could be analysed in a single shot measurement.

It is also known from Measurement Science Technology Volume 8 (1977), pages 676 to 678, "Optical Multi-Frame System With One Gated Intensifier As A Diagnostic For High-Speed Photography" A. Lorenz et al to provide an optical system using a single gated optical image intensifier with different optical delay elements feeding signals to that intensifier such that when gated an image is obtained it shows an object at different relative times.

Viewed from one aspect the present invention provides an image intensifier comprising:

an optical splitter operable to split radiation received from a radiation source into a plurality of optical channels;

a gated optical image intensifier having a plurality of image intensifying channels operable to intensify radiation received from a respective one of said plurality of optical channels; and an electronic gating signal generator operable to generate independent time gating signals applied to respective ones of said plurality of intensifying channels such that said plurality of intensifying channels intensify radiation received from said radiation source at different times.

The present technique recognises the above described problems associated with capturing image data with different delay times and provides a solution whereby a gated optical image intensifier includes multiple intensifying channels which are separately electronically gated and supplied with their own radiation to be imaged via an optical splitter. In this way, multiple time spaced images can be rapidly captured enabling as practical a wide range of high speed imaging applications. It will be appreciated that the image intensifier may in practice have a gain of less than one although it would normally seek to make the image brighter.

It will be appreciated that the gated optical image intensifier could be provided as a group of separate units working in unison. However, in preferred embodiments the gated optical image intensifier is a unitary device such that the image intensifying channels share common gain controlling parameters. This is strongly advantageous as it allows the intensity sensed by each intensifying channel to be compared with other channels without undue work being needed to calibrate discrete gated optical image intensifiers. As an example, the geometry of different intensifiers might vary slightly with a significant impact upon the gain achieved. The cathode spectral response, voltage applied, temperature, MCP (micro channel plate) strip current and other characteristics could also change in a manner which would otherwise influence gain. Providing a unitary device reduces these gain altering influences.

A particularly convenient way of providing the multiple optical channels is to use a gated optical image intensifier including a photocathode divided into a plurality of separately gated radiation receiving areas. Such a photocathode can relatively readily be formed, such as by evaporation, and enables a unitary device to support multiple channels.

The effectiveness of the separately gated radiation receiving areas is improved when they are separated from each other by resistive strips which provide ac electrical de-coupling therebetween. In the context of gated optical image intensifiers incorporating a photocathode, it is advantageous to use a gated signal mesh disposed adjacent to the photocathode with a single vacuum feed and divided into a plurality of mesh portions (or other gated electrode structures) overlying (indexed with) the respective radiation receiving areas and operable to couple the gating signal thereto.

Whilst the multi channel gated optical image intensifiers of the present technique are useful in a wide variety of applications, they are particularly well suited to fluorescence lifetime imaging in which high speed imaging at different temporal points is necessary in order to determine a fluorescence lifetime characteristic and so gain information concerning the nature of the object being imaged. Other applications include fluorescence correlation spectroscopy (FCS), imaging through diffuse media, imaging physiological electrical signals, endoscopic imaging and histopathological imaging, and fluorescence lifetime based assays, e.g. for high throughput screening.

In the context of fluorescence lifetime imaging preferred embodiments utilise an optical splitter that divides the fluorescence radiation between the optical channels in proportions corresponding to the expected fluorescence characteristic being measured in an effort to maintain as constant the intensity of fluorescence radiation sampled in each channel. Dividing the fluorescence radiation in this way helps to improve the signal-to-noise ratio of the device by ensuring that the detector is not unduly saturated during the images taken shortly after fluorescent stimulation whilst maintaining a sufficiently bright image at the furthest time from fluorescent stimulation.

It has been found that a particularly preferred and practical form of gated optical image intensifier that provides a good balance between the number of channels provided, and accordingly temporal sampling points achievable, coupled with the size, complexity and cost of the device is where three or four channels are provided by the optical splitter and gated optical image intensifier.

Viewed from another aspect the present invention provides a method of image intensification, said method comprising the steps of:

splitting radiation received from a radiation source into a plurality of optical channels with an optical splitter;

intensifying radiation received from said plurality of optical channels within respective ones of a plurality of intensifying channels of a gated optical image intensifier; and generating independent time gating signals applied to respective ones of said intensifying channels such that said plurality of intensifying channels intensify radiation received.

Figure 3:
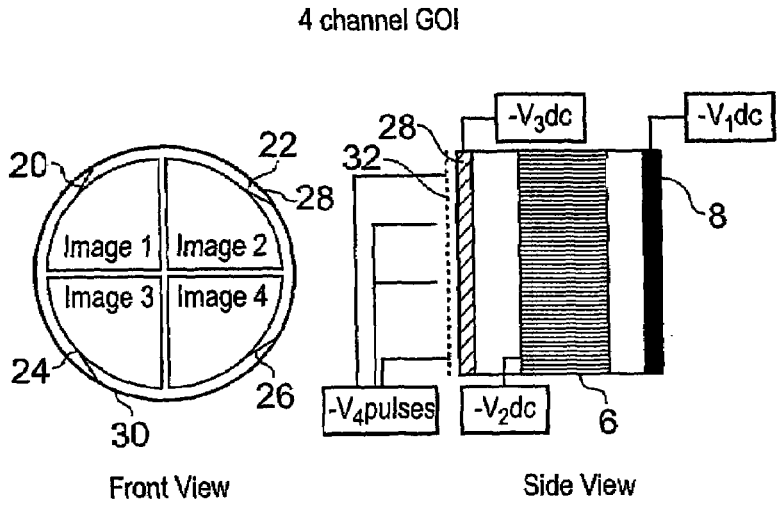
Figure 5:
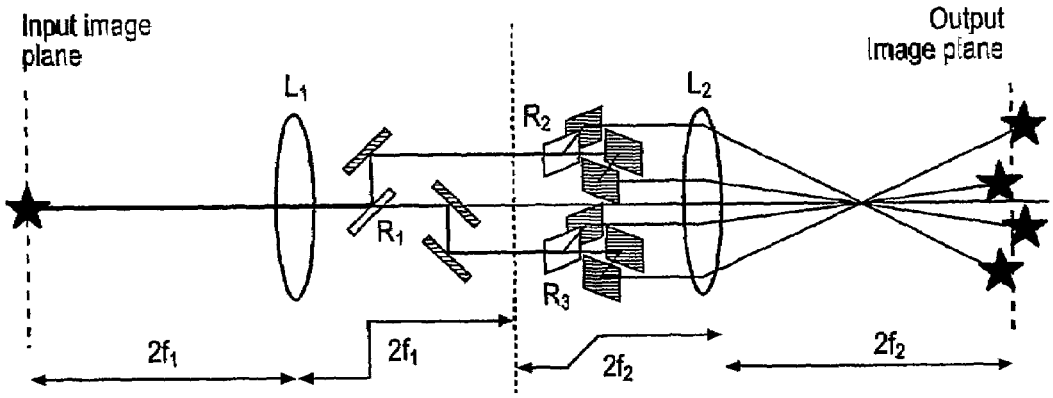
Figure 4:
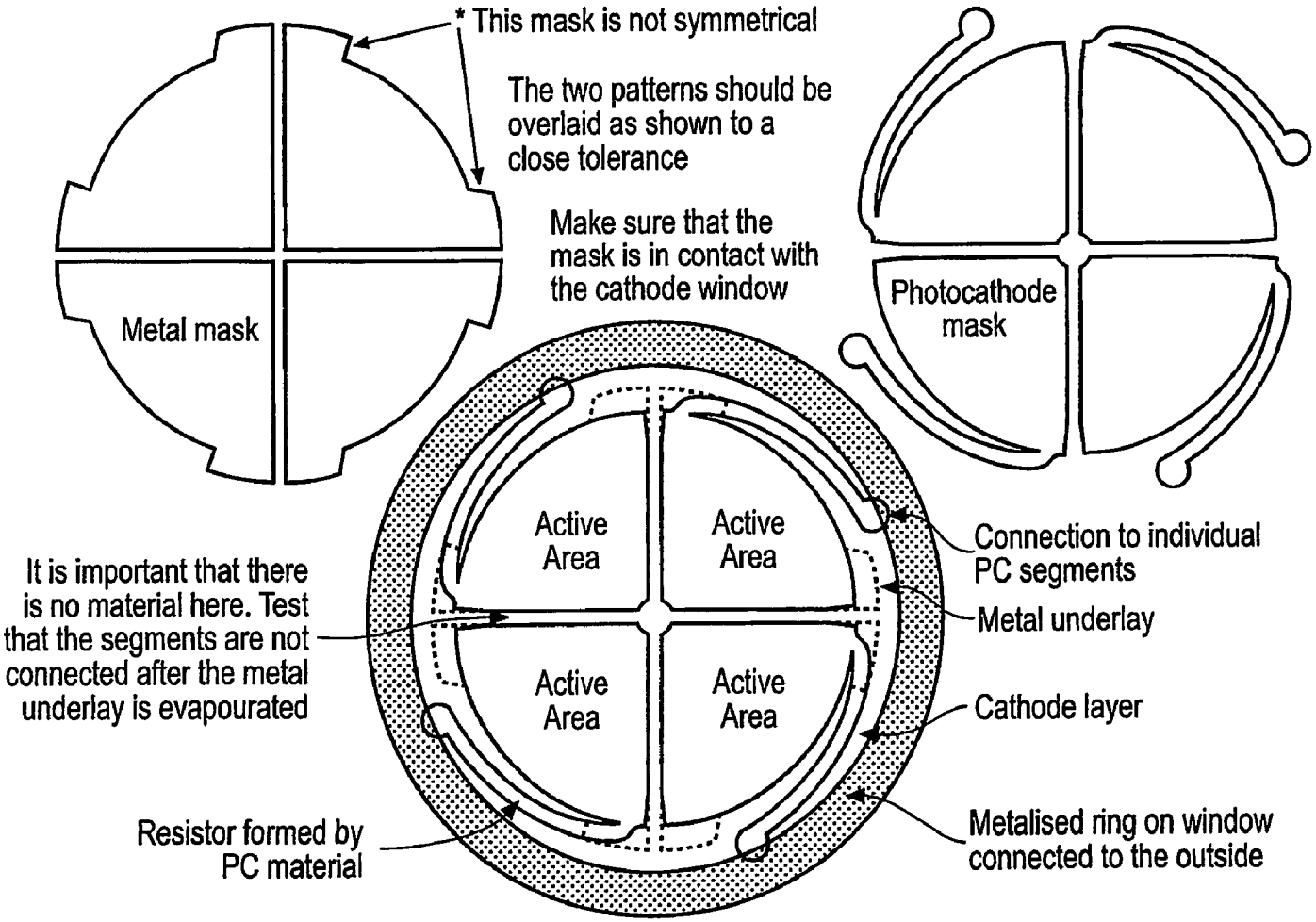

Embodiments of the invention will now be described, by way of example only, with reference to the accompanying drawings in which:

FIG. 1 schematically illustrates a gated optical image intensifier;

FIG. 2 schematically illustrates time-domain fluorescence lifetime imaging;

FIG. 3 schematically illustrates a four-channel gated optical image intensifier in accordance with one example embodiment of the present techniques;

FIG. 4 shows example gating signal electrode arrangements;

FIG. 5 schematically illustrates a four-channel image splitter; and

Figure 6:
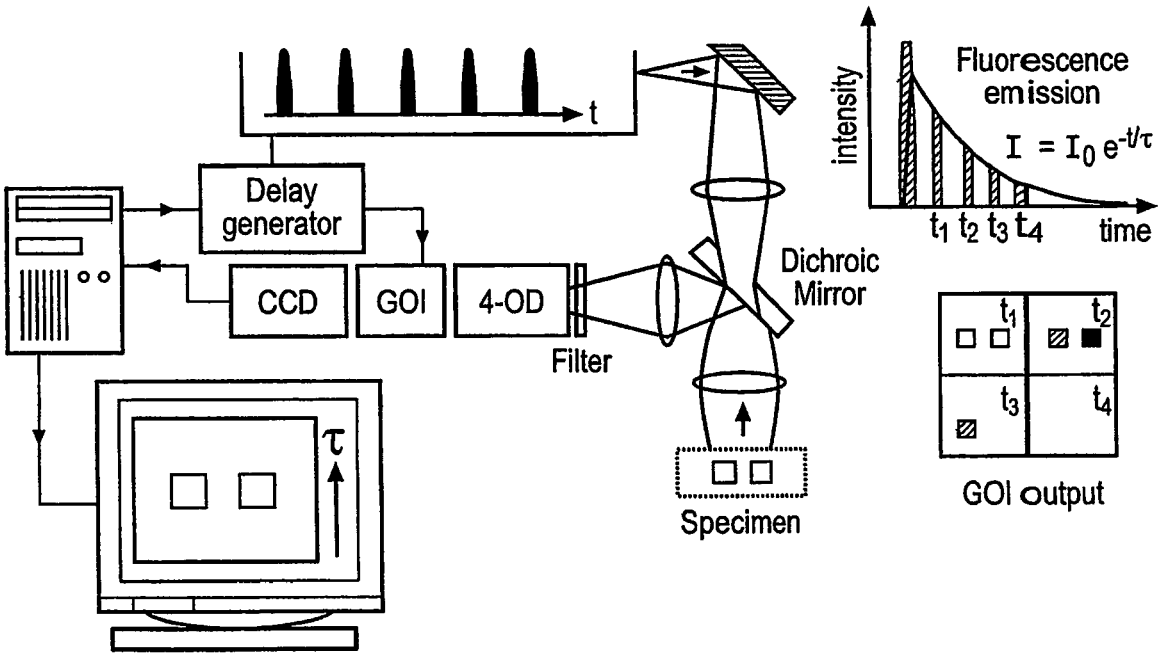

FIG. 6 schematically illustrates single-shot fluorescence lifetime imaging implemented using a four-channel gated optical image intensifier such as that shown in FIG. 3.

One approach to implementing the current techniques would be to optically divide the signal to be measured into a number of less intense signals and direct each of these to a separate GOI. All the GOI's would need to be synchronised with the excitation or trigger signal. This would be possible but expensive and the set-up would require considerable calibration of the properties (sensitivity, gain response time etc) of each GOI.

A more attractive approach, is to provide a multi-channel GOI which acquires multiple time-gated wide-fields simultaneously, but with different delay settings, in the same image intensifier set-up. This may then be combined with an appropriate optical arrangement to direct fractions of the incident signal to each imaging sub-field for parallel acquisition.

FIG. 3 shows a schematic of a 4-channel GOI. The photocathode 28 is divided into 4 (or more) segments (areas) 20, 22, 24, 26 by evaporating the photocathode 28 through a mask. This results in four isolated cathode areas 20, 22, 24, 26. Resistive strips 30 are evaporated at the edge of each section to allow a bias to be applied the cathodes maintaining a relatively long RC time via this resistance. This permits gating pulses to be applied to each quarter image area at different delay times without the requirement for a separate vacuum feed through connection to each cathode segment, 20, 22, 24, 26, the voltage pulse being applied to each cathode segment via the capacitive coupling to external electrodes. In this example, the external gating signal electrodes are four quadrant meshes 32 situated close to each cathode segment, but outside the envelope of the intensifier tube. Each separate channel could in principle be gated by different but synchronised gating pulses. In this embodiment they are all gated by fractions of the same electrical pulse, albeit with different relative delays.

It is possible to make GOIs with an electrode which is completely outside the optical path, but which still has enough capacitive coupling to gate the cathode. It is desirable to avoid a mesh, where possible, as it attenuates the light which is incident upon the photocathode. The cathode arrangements for an example four frame camera are illustrated in FIG. 4. In this case the external gating electrodes, which need not be meshes, are positioned outside the path of the incident light, but over and capacitively coupled to, fingers of metalisation which extend outside the optically sensitive areas of the photocathode sections. These may be seen in the metalisation mask. By this means the optical attenuation associated with the mesh may be avoided.

In order to fully realise 4-channel optical imaging, it is necessary to divide the incident optical signal into four parallel channels. A schematic of an arrangement to do this is given on FIG. 5. This is a sequence of beam splitters incorporate an image relay system.

The imaging aspects of this 4-channel image splitter can vary, and a suitable system is commercially available from Optical Insights, Inc. This technique addresses the use of a multi-channel GOI with an appropriate optical splitter in front of it to produce the required number of parallel image channels. FIG. 6 shows how this technique may be applied to single-shot FLIM.

This approach to multi-channel imaging may be improved by optimising the splitting ratios in the optical image divider in front of the GOI. If the power in the incident image is divided equally (i.e. $R_1=R_2=R_3=50\%$ as in FIG. 4), then, because of the finite dynamic range of the GOI, the later (more delayed) time gated images will be acquired with reduced signal levels (and s/n levels) compared to the first time-gated image. A further aspect of the present technique is to set the reflectivities of the beam splitters such that all the time-gated images are of roughly equal (or at least closer to equal) intensity. If the incident image intensity is $I_0$, then the intensities of the 4 output images can be described by:

$$I_1=I_0 R_1 R_2$$

$$I_2=I_0 R_1 (1-R_2)$$

$$I_3=I_0 (1-R_1) R_3$$

$$I_4=I_0 (1-R_1) (1-R_3)$$

Clearly these values can be adjusted such that if $I_1$ is the first time-gated image, running through to $I_4$ as the last time-gated image, then $I_4>I_1$. As an example, if splitting ratios of 25%, 25%, 40% are used for $R_1$, $R_2$, $R_3$ respectively, then:

$$I_1=0.0625\ I_0$$

$$I_2=0.1875\ I_0$$

$$I_3=0.3\ I_0$$

$$I_4=0.45\ I_0$$

In practice the beam-splitter reflectivities can be more precisely adjusted such that the sub-image intensities, $I_1$-$I_4$, reflect the expected exponential decrease in the fluorescence signal as a function of time delay. If one estimates a fluorescence decay time, $\tau$, then one can derive the following beam-splitter reflectivity's (assuming no losses) as a function of the time delays for each time-gated image.

$$R_2 = [1 + e^{-(t_2-t_1)/\tau}];\ R_3 = [1 + e^{-(t_4-t_3)/\tau}];\ R_1 = \left[1 + \frac{R_2}{R_3} e^{(t_3-t_1)/\tau}\right]$$

Of course this would only be matched to samples with a given fluorescence decay time, but in practice many biological fluorophores have a mean fluorescence decay time close to 2 ns and this would be a reasonable number to use for a multi-channel FLIM system to be applied to a variety of different biological samples. For specific areas of application, these beam-splitter ratios could be adjusted to suit assumptions appropriate to that application. For many applications, simply taking the values of 25%, 25%, 40% for $R_1$, $R_2$, $R_3$ respectively significantly improves the s/n of the FLIM process and delivers improved FLIM data—even compared to current sequentially sampling FLIM instruments, for which the gain is not typically adjusted as the delay of the time gate is varied.

This multi-channel GOI technology can be applied to any application area of time-gated imaging, including to FLIM, FCS, time-gated imaging through diffuse media and the imaging of rapid events on sub-ns timescales.

High-speed single-shot FLIM can be implemented with a fast frame-rate CCD camera to realise a FLIM system capable of acquiring 100 s of fluorescence lifetime maps/second. This can be applied to study fast processes in biology, medicine and other areas. One example would be the imaging of physiological voltage signals using voltage sensitive fluorescent probes. This can be used to study neuron activity. As well as furthering research, this would have applications in areas such as toxicology, where the physiological voltage signals can indicate apoptosis (or the lack of it). It would also be useful for endoscopy and other clinical FLIM applications where real-time feedback to the clinician is important.

The single-shot FLIM technology can also be applied to imaging microfluidic systems, e.g. reagents mixing in lab-on-a-chip technology. It can be combined with polarisation-resolved imaging to image time-resolved fluorescence anisotropy. This application can involve modifying the optical image splitter to incorporate polarising beam-splitters.

FLIM may have applications to non-invasively assess the quantum electronic properties of non-biomedical samples. One example would be the assessment and investigation of organic LED displays. High-speed single-shot FLIM could be implemented on a production line to rapidly assess a number of samples (displays) or to monitor dynamics in the operation of one or more devices.

The new technology permits more rapid acquisition of multi-channel time-resolved data, particularly in applications such as imaging through diffuse media, where a number of parallel detection channels are fibre-optically coupled to the GOI.

The invention claimed is:

1. An image intensifier comprising:

an optical splitter operable to split radiation received from a radiation source into a plurality of optical channels;

a gated optical image intensifier having a plurality of image intensifying channels operable to intensify radiation received from a respective one of said plurality of optical channels; and an electronic gating signal generator operable to generate independent time gating signals applied to respective ones of said plurality of intensifying channels such that said plurality of intensifying channels intensify radiation received from said radiation source at different times, wherein said optical splitter divides fluorescence radiation from said object in proportions such that those optical channels corresponding to intensifying channels that are gated to intensify later in said time gating sequence receive more of said fluorescence radiation.

2. A method of image intensification, said method comprising the steps of:

splitting radiation received from a radiation source into a plurality of optical channels with an optical splitter;

intensifying radiation received from said plurality of optical channels within respective ones of a plurality of intensifying channels of a gated optical image intensifier; and generating independent time gating signals applied to respective ones of said intensifying channels such that said plurality of intensifying channels intensify radiation received, wherein said optical splitter divides fluorescence radiation from said object in proportions such that those optical channels corresponding to intensifying channels that are gated to intensify later in said time gated sequence receive more of said fluorescence radiation.

3. An image intensifier comprising:

an optical splitter operable to split radiation received from a radiation source into a plurality of optical channels;

a gated optical image intensifier having a plurality of image intensifying channels operable to intensify radiation received from a respective one of said plurality of optical channels; and an electronic gating signal generator operable to generate independent time gating signals applied to respective ones of said plurality of intensifying channels such that said plurality of intensifying channels intensify radiation received from said radiation source at different times, wherein said plurality of intensifying channels are operable to intensify fluorescence radiation received from an object at respective times following excitation of fluorescence in said object so as to perform fluorescence lifetime imaging, wherein said optical splitter divides fluorescence radiation from said object in proportions such that those optical channels corresponding to intensifying channels that are gated to intensify later in said time gating sequence receive more of said fluorescence radiation.

4. An image intensifier as claimed in claim 3, wherein said gated optical image intensifier is a unitary device such that said plurality of image intensifying channels share common gain controlling parameters.

5. An image intensifier as claimed in claim 3, wherein said gated optical image intensifier includes a photocathode divided into a plurality of separately gated radiation receiving areas.

6. An image intensifier as claimed in claim 5, wherein said plurality of separately gated radiation receiving areas are divided from each other by resistive strips so as to provide AC electrical separation therebetween.

7. An image intensifier as claimed in claim 5, wherein said gated image intensifier includes a gating signal electrode disposed adjacent said photocathode, said gating signal electrode being divided into a plurality of electrode portions indexed with respective ones of said plurality of separately gated radiation receiving areas and operable to couple a gating signal thereto.

8. An image intensifier as claimed in claim 3, wherein said electronic gating signal generator is triggered to generate said independent time gating signals by a shared trigger signal.

9. An image intensifier as claimed in claim 3, wherein the radiation source comprises an object illuminated by a pulsed laser source.

10. An image intensifier as claimed in claim 8, wherein said shared trigger signal is synchronised with said pulsed laser source.

11. An image intensifier as claimed in claim 3, wherein said fluorescence radiation is divided between said optical channels in proportions such that given an expected fluorescence lifetime decay characteristic each intensifying channel will receive an intensity of radiation whilst gated that is substantially constant between intensifying channels.

12. An image intensifier as claimed in claim 3, wherein said optical splitter and said gated optical image intensifier each both comprise three or four channels.

13. An image intensifier as claimed in claim 3, wherein said image intensifier is adapted to perform one of:

fluorescence correlation spectroscopy;
imaging through diffuse media;
imaging physiological electrical signals;
endoscopic imaging; and
histopathological imaging.

14. A method of image intensification, said method comprising the steps of:

splitting radiation received from a radiation source into a plurality of optical channels with an optical splitter;

intensifying radiation received from said plurality of optical channels within respective ones of a plurality of intensifying channels of a gated optical image intensifier; and generating independent time gating signals applied to respective ones of said intensifying channels such that said plurality of intensifying channels intensify radiation received, wherein said plurality of intensifying channels are operable to intensify fluorescence radiation received from an object at respective times following excitation of fluorescence in said object so as to perform fluorescence lifetime imaging, wherein said optical splitter divides fluorescence radiation from said object in proportions such that those optical channels corresponding to intensifying channels that are gated to intensify later in said time gated sequence receive more of said fluorescence radiation.

15. A method as claimed in claim 14, wherein said gated optical image intensifier is a unitary device such that said plurality of image intensifying channels share common gain controlling parameters.

16. A method as claimed in claim 14, wherein said gated optical image intensifier includes a photocathode divided into a plurality of separately gated radiation receiving areas.

17. A method as claimed in claim 16, wherein said plurality of separately gated radiation receiving areas are divided from each other by resistive strips so as to provide AC electrical separation therebetween.

18. A method as claimed in claim 16, wherein said gated image intensifier includes a gating signal electrode disposed adjacent said photocathode, said gating signal electrode being divided into a plurality of electrode portions indexed with respective ones of said plurality of separately gated radiation receiving areas and operable to couple a gating signal thereto.

19. A method as claimed in claim 14, wherein a shared trigger signal triggers generation of said independent time gating signals.

20. A method as claimed in claim 14, wherein the radiation source comprises an object illuminated by a pulsed laser source.

21. A method as claimed in claim 19, wherein said shared trigger signal is synchronised with said pulsed laser source.

22. A method as claimed in claim 14, wherein said fluorescence radiation is divided between said optical channels in proportions such that given an expected fluorescence lifetime decay characteristic each intensifying channel will receive an intensity of radiation whilst gated that is substantially constant between intensifying channels.

23. A method as claimed in claim 14, wherein said optical splitter and said gated optical image intensifier each both comprise three or four channels.

24. A method as claimed in claim 14, wherein said method is operable to perform one of:

fluorescence correlation spectroscopy;
imaging through diffuse media;
imaging physiological electrical signals;
endoscopic imaging; and
histopathological imaging.

* * * * *